US006006727A

United States Patent [19]

Katashiba et al.

[11] Patent Number: 6,006,727

[45] Date of Patent: Dec. 28, 1999

[54] FUEL CONTROL SYSTEM FOR INTERNAL COMBUSTION ENGINE

[75] Inventors: Hideaki Katashiba; Ryoji Nishiyama; Hironori Matsumori, all of Tokyo, Japan

[73] Assignee: Mitsubishi Denki Kabushiki Kaisha, Tokyo, Japan

[21] Appl. No.: 08/970,204

[22] Filed: Nov. 14, 1997

[30] Foreign Application Priority Data

Nov. 15, 1996 [JP] Japan ..... 8-304970

[51] Int. Cl.[6] ..... F02M 51/00

[52] U.S. Cl. ..... 123/435; 123/491

[58] Field of Search ..... 123/491, 435

[56] References Cited

U.S. PATENT DOCUMENTS

| | | | |
|---|---|---|---|
| 4,487,184 | 12/1984 | Boning et al. | 123/435 |
| 4,838,230 | 6/1989 | Matsuoka | 123/491 |
| 5,036,669 | 8/1991 | Earleson et al. | 123/435 |
| 5,343,844 | 9/1994 | Fukui et al. . | |
| 5,415,145 | 5/1995 | Letcher et al. | 123/491 |
| 5,425,339 | 6/1995 | Fukui . | |
| 5,497,752 | 3/1996 | Sagisaka et al. | 123/491 |
| 5,690,073 | 11/1997 | Fuwa | 123/491 |
| 5,755,206 | 5/1998 | Takahashi et al. | 123/435 |
| 5,870,986 | 2/1999 | Ichinose | 123/179.16 |

OTHER PUBLICATIONS

"Ion–gap sensing for engine control", Automotive Engineering, Sep. 1995, pp. 65–68.

"Ion–Gap Sense in Misfire Detection, Knock and Engine Control", SAE Paper 950004, pp. 21–28, Jan. 1995.

*Primary Examiner*—Erick R. Solis

*Attorney, Agent, or Firm*—Sughrue, Mion, Zinn Macpeak & Seas, PLLC

[57] ABSTRACT

A method for deciding the combustion state of each cylinder on the basis of an ion current signal generated between gaps of an ignition plug in an internal combustion engine, and a fuel control system which reduces a fuel injection quantity while suppressing the combustion change of each cylinder and reduces a non-combustion composition in an engine exhaust gas after starting of engine. The fuel control system for an internal combustion engine comprises: cylinder-individual fuel injection quantity correcting means 45, 46 for correcting the fuel quantity injecting quantity in each cylinder so that the sum of fuel injection quantities to be supplied to the cylinders of the internal combustion engine having a plurality of cylinders decreases in each combustion cycle of each said cylinder and a difference between the combustion state value of the first cylinder of the internal combustion engine and that of the second cylinder thereof decreases; and fuel injecting means 20 for injecting into each cylinder the fuel injection quantity for each cylinder of said internal combustion engine corrected by said fuel injection quantity correcting means for each cylinder.

5 Claims, 7 Drawing Sheets

FUEL CONTROL SYSTEM FOR INTERNAL COMBUSTION ENGINE

BACKGROUND OF THE INVENTION

The present invention relates to a system for deciding the combustion state of each cylinder in an internal combustion engine, and a fuel control system which optimizes a fuel injection quantity while suppressing the combustion change of each cylinder after starting of engine and reduces a non-combustion composition in an engine exhaust gas.

Generally, a multi-cylinder engine having a fuel injection system has different combustion states due to different injection characteristics of fuel injection valves and different intake air distributions for the respective cylinders.

Particularly, when a cooled engine is started, in order to compensate for the attenuation of the vaporizing characteristic of fuel, a fuel injection quantity is increased according to the temperature of engine coolant. The quantity of fuel to be increased in starting of engine is set for a prescribed value for all cylinders relative to the cylinder having the poorest fuel contribution.

Therefore, a large quantity of incomplete combustive fuel is exhausted from a cylinder to which excessive fuel has been supplied when the engine is started, thus giving rise to a problem of air pollution.

In order to solve such a problem, it is necessary to control the distribution of fuel to be injected for each cylinder to supply an optimum quantity of injection fuel to each cylinder so that the combustion states of the respective cylinders are averaged and the fuel injection quantity set according to a coolant temperature and others is reduced within a range not deteriorating the combustion state.

In order to detect fuel distributed properly, means for directly measuring the combustion state of each cylinder is required. As an example thereof, a technique using an ion current is disclosed in JP-A-7-293306.

Such a combustion control technique for each cylinder (also referred to as cylinder-individual combustion control technique) is to control fuel for each cylinder on the basis of the comparison of an ion current output maximum value and an integrated value of each cylinder with a reference value so as to reduce the fuel injection quantity for each cylinder.

The above conventional cylinder-individual combustion control technique controls the fuel injection quantity for each cylinder by reducing a difference in the combustion state among the respective cylinders. Therefore, it can suppress engine vibration due to a difference in the combustion state among the respective cylinders. But it does not necessarily reduce the fuel injection quantity for all the cylinders and hence does not perform an optimum control.

Further, the above conventional cylinder-individual combustion control technique decides the combustion state on the basis of the maximum value and integrated value of the ion current acquired from the combustion state in a present cycle of each cylinder. However, the combustion state of each cylinder varies for each cycle. Therefore, the conventional control technique cannot provide a correct value of the combustion state only from the combustion state in the present cycle, thus making it impossible to make appropriate decision.

SUMMARY OF THE INVENTION

The present invention has been accomplished in order to solve such a problem.

The present invention intends to provide a fuel control system which corrects the fuel injection quantity for all cylinders and also for each cylinder so that the fuel injection quantity is reduced in average while the combustion change among the cylinders is suppressed, thereby reducing a quantity of exhaust gas. The present invention also intends to provide a fuel control system which can provide an appropriate combustion state even when the combustion state varies in each cycle by taking the combustion state in a cycle prior to a present cycle.

The fuel control system for an internal combustion engine according to the present invention comprises: a cylinder-individual fuel injection quantity correcting means for correcting the fuel quantity injection quantity in each cylinder so that the sum of fuel injection quantities to be supplied to the cylinders of the internal combustion engine having a plurality of cylinders decreases in each combustion cycle of each the cylinder and a difference between the combustion state value of the first cylinder of the internal combustion engine and that of the second cylinder thereof decreases; and a fuel injecting means for injecting into each cylinder the fuel injection quantity for each cylinder of the internal combustion engine corrected by the fuel injection quantity correcting means for each cylinder.

The fuel control system for an internal combustion engine according to the present invention comprises: a cylinder-common fuel injection quantity correcting means for each cylinder for correcting the fuel injection quantity to be supplied to each cylinder so that the sum of fuel quantity injection quantities to be supplied to the cylinders of the internal combustion engine having a plurality of cylinders varies in each combustion cycle of each the cylinder; a cylinder-individual fuel injection quantity correcting means for correcting the fuel quantity in each cylinder so that a difference in the combustion state value between the first cylinder of the internal combustion engine and that of the second cylinder thereof decreases; and a fuel injecting means for injecting into each cylinder the fuel injection quantity for each cylinder of the internal combustion engine corrected by the cylinder-individual fuel injection quantity correcting means and the cylinder-common fuel injection quantity correcting means, wherein the cylinder-common fuel injection quantity correcting means corrects the fuel injection quantity to be supplied to each the cylinder in accordance with the fuel injection quantity for each cylinder corrected by the cylinder-individual fuel injection quantity correcting means.

The cylinder-common fuel injection quantity correcting means changes the fuel injection quantity supplied to each the quantity by a degree corresponding to the fuel injection quantity for each cylinder corrected by the cylinder-individual fuel injection quantity correcting means.

The fuel injection quantity supplied to each the cylinder for each combustion cycle of each cylinder is corrected in accordance with the environmental condition of the internal combustion engine.

The environmental condition for the internal combustion engine is at least one of a cooled water temperature of the internal combustion engine, intake air temperature, atmospheric pressure, battery, and fuel quantity supplied to the internal combustion engine.

The cylinder-individual fuel injection quantity correcting means comprises: a combustion state quantity computing means for computing the combustion state quantity for each cylinder from each combustion state of at least two cylinders of the internal combustion engine; and a combustion change quantity computing means for computing the combustion change quantity in each the cylinder on the basis of the combustion state quantity in a present cycle and a cycle prior to the present cycle computed by the combustion state quantity computing means, wherein the fuel injection quantity for each the cylinder is corrected so that a difference in the combustion change quantity among the cylinders computed by the combustion change quantity computing means decreases.

The fuel injecting means corrects the fuel injection quantity of a cylinder with a larger deviation from the average value of the combustion change quantities of the cylinders.

The fuel control system for an internal combustion engine according to the present invention comprises: a combustion state quantity computing means for computing the combustion state quantity of each cylinder from each combustion state of at least two cylinders of an internal combustion engine having a plurality of cylinders; and a combustion change quantity computing means for computing the combustion change quantity of each the cylinder on the basis of the combustion state quantities in a present cycle and a cycle prior to the present cycle computed by the combustion state quantity computing means; and a cylinder-individual fuel injection quantity correcting means for correcting the fuel injection quantity of each the cylinder in accordance with the combustion change quantity in each cylinder computed by the combustion change quantity computing means.

The cylinder-individual fuel injection quantity correcting means computes the ratio of the average value of the combustion change quantities in the respective cylinders to the combustion change quantity in each cylinder as an inter-cylinder difference to correct the fuel injection quantity in each cylinder so that the inter-cylinder difference is decreased.

The combustion state quantity computing means detects an ion current passed through at least two cylinders of the internal combustion engine to compute the combustion state quantity of each the cylinder from the ion current.

The combustion state quantity is represented by an ion current integrated value or main combustion period.

The main combustion period represents a period when the ion current detected by the ion current detecting means is not smaller than a prescribed value.

The combustion change quantity computing means computes a combustion change quantity on the basis of a ratio of the absolute difference between the first combustion state quantity in a present cycle and the second combustion state quantity in a cycle prior to the present cycle computed by the combustion state quantity computing means to the average value of the first and second combustion state quantities, and integrating the combustion change state thus computed by a prescribed number of cycles to compute the combustion change quantity.

The combustion change quantity computing means computes a combustion change quantity by computing a difference between the combustion state quantity in a present cycle computed by the combustion state quantity computing means and a shifting average value of the combustion state quantities during a prescribed number of cycles prior to the present cycle.

PREFERRED EMBODIMENTS OF THE INVENTION

Embodiment 1

Figure 1:
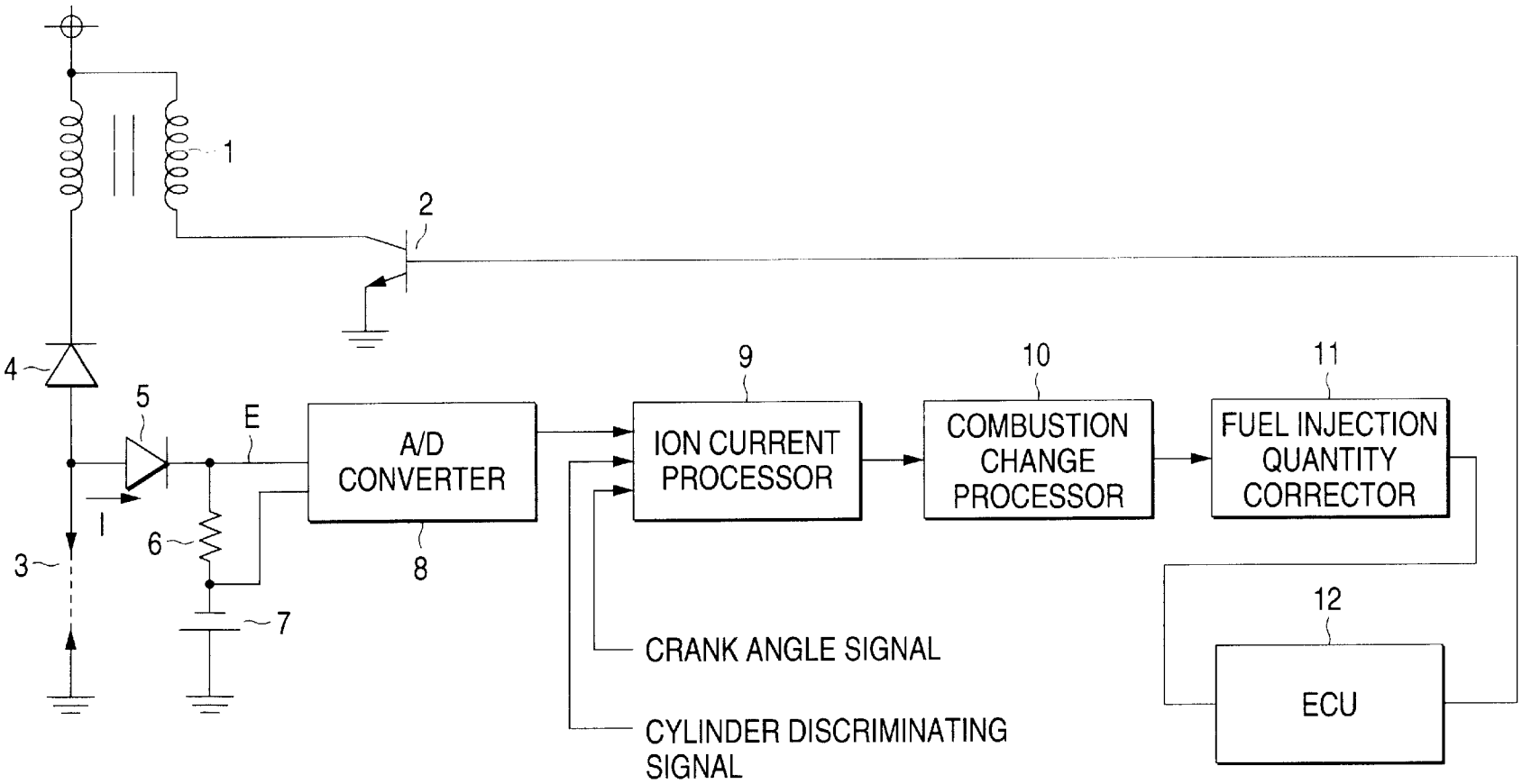
FIG. 1 is a view showing an arrangement of a fuel control system according to the first embodiment of the present invention.

An explanation will be given of the first embodiment of the present invention. FIG. 1 is a view showing the arrangement of a fuel control system for an engine according to the first embodiment of the present invention. Reference numeral 1 denotes an ignition coil; 2 a power transistor connected to the primary coil side of the ignition coil 1 and emitter-grounded; 3 an ignition coil connected to the secondary coil side of the ignition coil 1; and 4 a diode for preventing current backflow inserted between the ignition coil 1 and the ignition plug 3. Now, although an ignition section (which includes the ignition coil 1, power transistor 2, ignition plug 3 and diode 4) is represented for a single cylinder, it is assumed that such an ignition section is provided for each cylinder.

Reference numeral 5 denotes a current backflow preventing diode connected to one terminal of the ignition plug 3; 6 a load resistor for converting an ion current into a voltage value; 7 a DC power source connected to the load resistor 6; and 8 an A/D converter for converting an ion current signal into its digital value.

Reference numeral 9 denotes an ion current processor for processing the ion current signal to produce a combustion state signal on the basis of a cylinder discriminating signal and a crank angle signal produced from a crank angle sensor (not shown) attached to the crank shaft of the engine. Reference numeral 10 denotes a combustion change processor for processing a combustion change state on the basis of the combustion state signal for each cylinder outputted for each combustion cycle from the ion current processor 9. Reference numeral 11 denotes a fuel injected quantity corrector for computing a fuel correction coefficient for each cylinder on the basis of the combustion change states of all cylinders. Reference numeral 12 denotes an engine control unit (hereinafter referred to as "ECU") which performs fuel injection for each cylinder, reduction of the fuel injection quantity and ignition timing control.

An explanation will be given of a method of computing the correction coefficient for each cylinder for controlling fuel for each cylinder.

First, immediately after the ignition coil 3 is discharged, the ion current I is passed through the ignition plug 3 and detected. The detected ion current I is converted into a voltage value by the load resistor 6. The A/D converter converts the voltage value into a digital signal to be supplied to the ion current processor 9.

The ion current processor 9 processes the ion current on the basis of the crank angle signal and cylinder discriminating signal produced from the crank angle sensor (not shown) to supply the combustion state signal thus obtained to the combustion change processor 10.

The combustion change processor 10 processes the combustion change state for each cylinder on the basis of the combustion state signals for each cylinder outputted in each present combustion cycle and in a cycle prior to the present cycle. The fuel injection quantity corrector 11 calculates the correction coefficients for fuel from the combustion change state of all the cylinders processed by the combustion change processor 10. The correction coefficients thus computed are supplied to the ECU 12.

Figure 2:
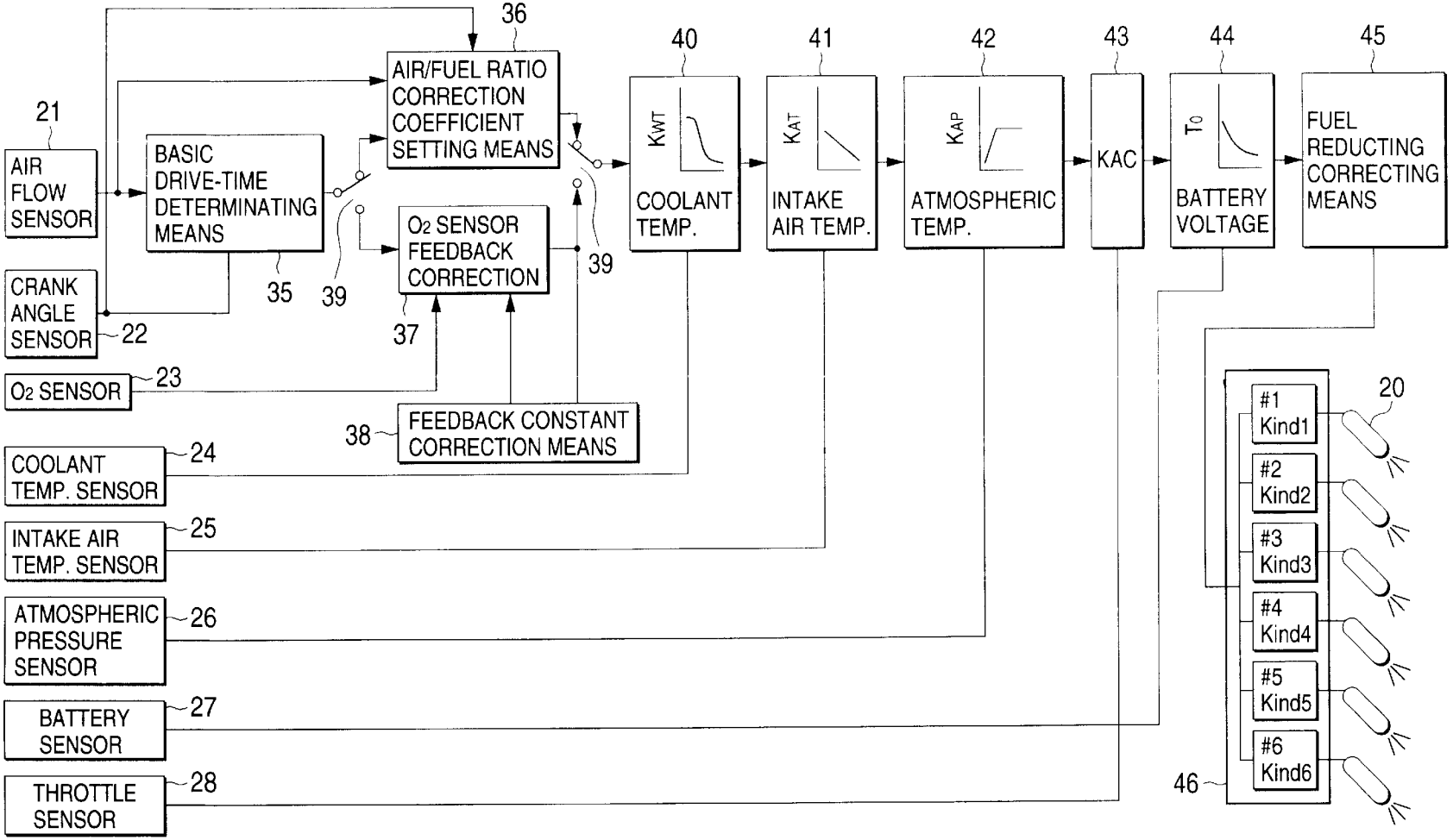
FIG. 2 is a block diagram showing the fuel control of the fuel control system shown in FIG. 1.

FIG. 2 is a system block diagram of fuel injection control in the ECU 12 shown in FIG. 1. In FIG. 2, reference numeral 20 denotes an injector for supplying fuel to the engine; 21 an air flow sensor for detecting the quantity of intake air to be supplied to the engine 23; 22 a crank angle sensor; 23 an $\mathbf{0}_2$ sensor for measuring the oxygen density in an exhaust gas; 24 a water temperature sensor for detecting the cooled water temperature of the engine; 25 an intake air temperature sensor for detecting the temperature of intake air to be supplied to the engine; 26 an atmospheric pressure sensor for the pressure in a surge tank; 27 a battery sensor; and 28 a throttle sensor for detecting the open/close state of a throttle valve.

Reference numeral 35 denotes a basic driving time determining means for determining the basic driving time TB to drive the injector 20; 36 an air/fuel ratio correction coefficient setting means for setting a first air/fuel ratio correcting coefficient $K_{AP1}$ corresponding to an engine speed and an engine load; 37 an $O_2$ sensor feedback correcting means for setting an air/fuel ratio $K_{AP2}$ to control the air/fuel ratio in the vicinity of a theoretical air/fuel ratio during an $O_2$ sensor feedback mode (described later); 38 a feedback constant correcting means for correcting the feedback constant to set the air/fuel ratio correction coefficient $K_{AF2}$; and 39 a switching means for switching the air/fuel ratio correction coefficient setting means 36 and $O_2$ sensor feedback correcting means 37 in interlock with each other.

Reference numeral 40 denotes a cooled water temperature correcting means for setting a correction coefficient $K_{WT}$ in accordance with an engine cooled water temperature detected by the water temperature sensor 24. Reference numeral 41 denotes an intake air temperature correcting means for setting a correction coefficient $K_{AT}$ in accordance with the intake air temperature measured by the atmospheric pressure sensor 26. Reference numeral 42 denotes an atmospheric pressure correcting means for setting a correction coefficient $K_{AP}$ in accordance with the atmospheric pressure measured by the atmospheric sensor 26. Reference numeral 43 denotes an acceleration incremental correcting means for setting a correction coefficient $K_{AC}$ for acceleration increment in accordance with the behavior of an accelerator pedal on the basis of the value detected by the throttle sensor 28. Reference numeral 44 denotes a dead time correcting means for setting a dead time TD to correct the driving time in accordance with the battery voltage measured by the battery sensor 27.

Reference numeral 45 denotes a fuel reduction correcting means for setting a cylinder-common correction coefficient $K_{mean}$ to reduce the fuel injection quantity immediately after starting of engine. Reference numeral 46 denotes a cylinder-individual correcting means for setting a cylinder-individual correcting coefficient $K_{indi}$ (i=1, . . . , 6) for each cylinder in accordance with the combustion state of each cylinder.

An explanation will be given of a fuel injection control method according to this embodiment.

In the ECU 12, the basic driving time determining means 35 computes the intake air quantity Q/Ne per one revolution of the engine on the basis of the intake air quantity Q signal detected by the air flow sensor 21 and the engine speed Ne signal detected by the crank angle sensor, and determines the basic driving time TB during which the injector 20 is driven on the basis of the intake air quantity.

The air/fuel ratio correction coefficient setting means 36 sets the first air/fuel ratio correction coefficient $K_{AF}$ corresponding to the engine speed Ne and the engine load (the above Q/Ne has engine load information) from a map (the state where the first air/fuel ratio correction coefficient $K_{AF1}$ has been set by the air/fuel ratio correction coefficient setting means 36 is referred to as "air/fuel ratio correcting mode").

By switching the switching means 39 into the side of the $O_2$ sensor feed back correcting means 37 in accordance with the engine running state, the air/fuel ratio correcting mode is exchanged into an $O_2$ sensor feedback mode (described later).

The $O_2$ sensor feedback correcting means 37 sets the air/fuel ratio correction coefficient $K_{AF2}$ to control the air/fuel ratio in the vicinity of the theoretical air/fuel ratio during the $O_2$ sensor feedback mode. On the basis of the detected value of the $O_2$ sensor 23 and a prescribed reference value (rich/lean decision voltage), the value of the air/fuel ratio correction coefficient $K_{AF2}$ is changed as follows.

$$K_{AF2}=1+I\pm(K_p/2)$$

Here, $K_p$ represents a proportional gain, and I represents an integration coefficient. The value of the air/fuel ratio correction efficient $K_{AF2}$ is updated by adding or the integration gain $K_I(=K_p/2)$. These proportional gain and integration gain have different values according to the rich/lean state detected on the basis of the information from the $O_2$ sensor 23.

The air/fuel ratio correction coefficient $K_{AF2}$ is modified or corrected in accordance with a change in the maximum value or minimum value of the amplitude of the air/fuel ratio correction coefficient $K_{AF2}$ by the feedback constant correcting means 38 (the state where the air/fuel ratio correction ratio $K_{AF2}$ is set by the $O_2$ sensor feedback correcting means 37 is referred to as "sensor feedback mode").

As described above, in accordance with the running state of the engine, the engine is in the air/fuel ratio correcting mode or $O_2$ sensor feedback mode.

After the correction coefficient in each mode has been set, the correction coefficient will be set on the basis of the following conditions.

The cooled water temperature correcting means 40 sets the correction coefficient $K_{WT}$ in accordance with an engine cooled water temperature detected by the water temperature sensor 24. The intake air temperature correcting means 41 sets the correction coefficient $K_{AT}$ in accordance with the intake air temperature measured by the atmospheric pressure sensor 26.

The atmospheric pressure correcting means 42 sets the correction coefficient $K_{AP}$ in accordance with the atmospheric pressure measured by the atmospheric sensor 26. The acceleration incremental correcting means sets a correction coefficient $K_{AC}$ for acceleration increment in accordance with the behavior of an accelerator pedal on the basis of the value detected by the throttle sensor 28. The dead time correcting means sets the dead time TD to correct the driving time in accordance with the battery voltage measured by the battery sensor 27.

The fuel reduction correcting means sets a cylinder-common correction coefficient $K_{mean}$ to reduce the fuel injected quantity immediately after starting of engine. The cylinder-common correcting coefficient $K_{mean}$ is set so that its value in each cycle is smaller than that in a prior cycle whereby the fuel injected quantity for all the cylinders decreases in each cycle.

The cylinder-individual correcting means 46 sets a cylinder-individual correcting coefficient $K_{ind1}$–$K_{ind6}$ for each cylinder in accordance with the combustion state of each cylinder on the basis of a combustion change of each cylinder obtained in the manner as shown in FIG. 1.

Thus, the driving time $T_{inj}$ of each injector 20 immediately after starting of engine can be obtained from the correction coefficients as follows:

$$T_{inj}=TB\times K_C\times K_{AF1}\times K_{mean}\times K_{indi}+TD$$

$$(i=1, \ldots, 6)$$

$$K_C=K_{WT}\times K_{AT}\times K_{AP}\times K_{AC}$$

Thus, the injector 20 is driven for the driving time $T_{inj}$.

In accordance with this embodiment, which explains the fuel control of a six-cylinder engine, six cylinder-individual correction coefficients are set. However, the present invention should not be limited to six cylinder-individual correction coefficients. The cylinder-individual correction coefficients may be acquired for a smaller number than 6 of cylinders. It is needless to say that the present invention can be applied to not only the fuel control of six-cylinder engine but also that of the other multi-cylinder engine.

Figure 3:
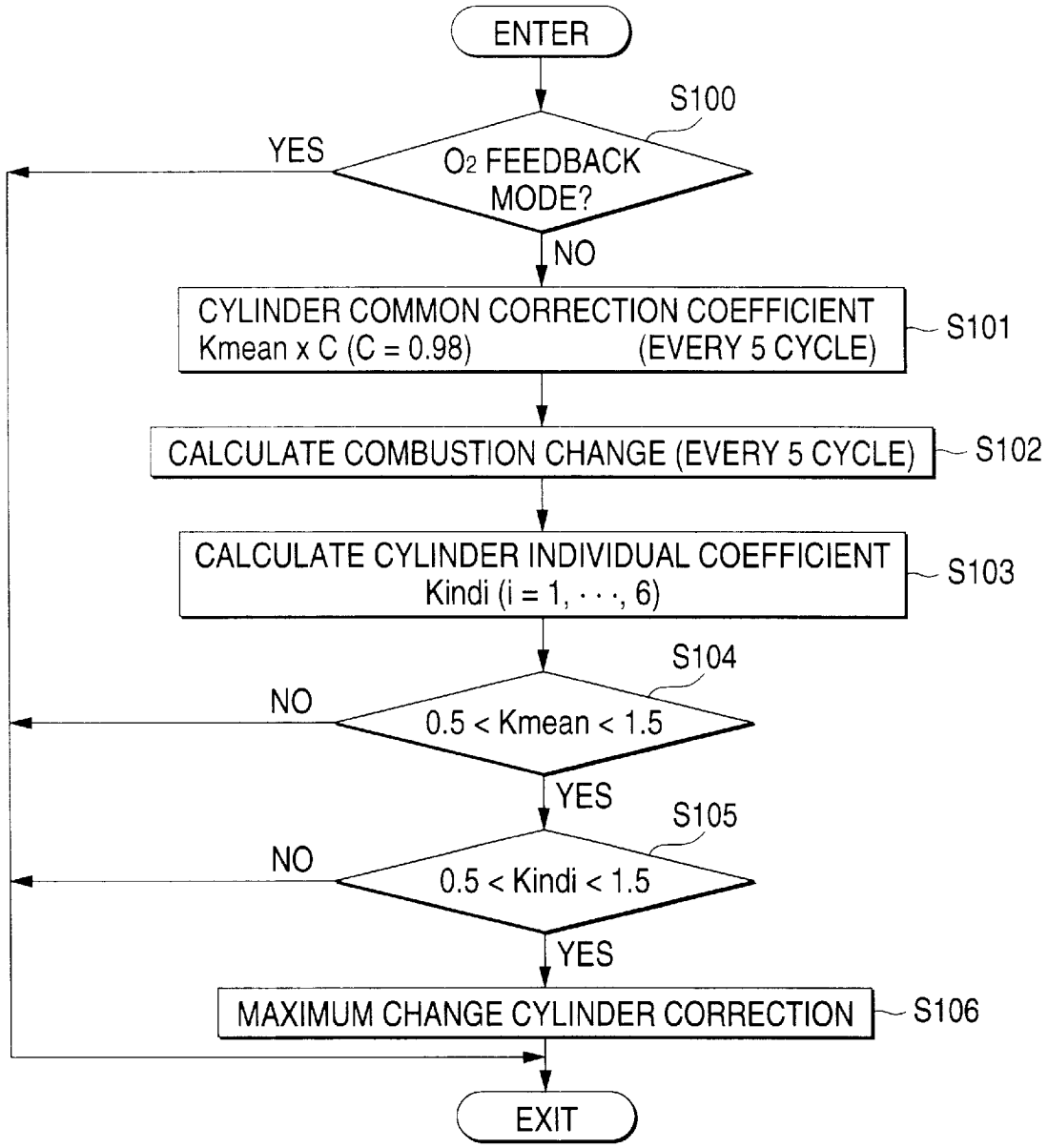
FIG. 3 is a flowchart showing the fuel control of the fuel control system shown in FIG. 1.

FIG. 3 is a flowchart of control of cylinder fuel injected quantity. The routine is performed for each crank angle interruption for fuel injection for each cylinder. FIG. 3 shows one cycle thereof.

Step 100 is a condition deciding routine for specifying the running state where the control is performed, which decides whether the present mode is the air/fuel ratio correcting mode or $O_2$ sensor feedback mode. If the decision result is the $O_2$ sensor feedback mode, the control routine is completed. If it is the air/fuel ratio correcting mode, the routine proceeds to step 101.

Namely, in this embodiment, this control will be carried out during the period from starting of engine to entering the O2 feedback mode.

In step 101, the cylinder-common correction coefficient $K_{mean}$ is reduced so that it is decreased for each cycle. In this case, since the measured value indicating the combustion by the ion current varies greatly according to each cycle, the cylinder-common correcting coefficient $K_{mean}$ is computed by statistical processing for e.g. combustion every five cycles.

In the engine or running state with a large change in combustion, the degree of reduction of the cylinder-common correction coefficient $K_{mean}$ is decreased, whereas in that with a small change in combustion, it is increased. In this way, the degree of reduction of the cylinder-common correction coefficient $K_{mean}$ must be varied according to the condition of engine or difference in the property of the engine.

In this embodiment, the cylinder-common correction coefficient $K_{mean}$ in the previous cycle is multiplied by a number less than 1 (0.98 in FIG. 3) to compute the cylinder-common correction coefficient $K_{meand}$. But, computation of the cylinder-common coefficient $K_{mean}$ should not be limited to this, but it may be computed by subtraction of a prescribed number. Further, in this embodiment, the processing is performed for each repetition of combustion of five cycles, but the number of cycles may be varied according to the condition of engine or difference in the property of the engine.

In step 102, as described in connection with FIG. 1, the combustion state quantity is computed from the combustion state detected for each cylinder to acquire a combustion change. In this case also, for this purpose, the statistical processing is carried out whenever five cycles are repeated taking into consideration a variation in the measured values representing the combustion in terms of the ion current.

In step 103, the cylinder-individual correction coefficient $K_{indi}$ ($i$=1, . . . , 6) for each cylinder is computed from the combustion change for each cylinder for every five cycles, computed in step 102.

In step 104, the upper and lower limits of the cylinder-common correction coefficient $K_{mean}$ is set. It is now assumed that the cylinder-common correction efficient $K_{mean}$ has a limit value in the range from 0.5 to 1.5. When it deviates from this range, the control is stopped.

In step 105, the upper and lower limits of the cylinder-individual correction coefficient $K_{ind}$ are set. It is now assumed that the cylinder-common correction efficient $K_{mean}$ has a limit value in the range from 0.5 to 1.5. When it deviates from this range, the control is stopped.

In this way, since the limit range of the correction coefficient is set in steps 104 and 105, even when the measured value varies greatly because of an accident of the device for detecting the ion current, an engine change can be minimized.

In step 106, the cylinder with the largest value of the cylinder correction coefficient is corrected on the basis of the cylinder-individual correction coefficient $K_{indi}$ for each cylinder so that a difference in the combustion change among the respective cylinders decreased. In this embodiment, only although the cylinder with the largest value of the correction coefficient for each cylinder is corrected, the cylinder with the largest or smallest correction coefficient or all the cylinders may be subjected to correction.

In this embodiment, the cylinder-common correction coefficient $K_{mean}$ and cylinder-individual correction coefficient $K_{indi}$ have computed separately. However, it is needless to say that they may be computed simultaneously.

In this embodiment, the cylinder correction coefficient of each cylinder is corrected so that a difference in the combustion change among the respective cylinders decreased and the cylinder-common correction coefficient for correction for all the cylinders is decreased for each cycle. The fuel injection quantity for all the cylinders can be reduced while the combustion change among the cylinders is suppressed.

Further, in step 101, the cylinder-common correction coefficient $K_{mean}$ is not reduced by a prescribed number for each cycle, but the rate of reduction may be changed in accordance with the cylinder-individual correction $K_{indi}$ corrected in step 103. Specifically, in step 101, if the correction quantity of the cylinder-individual correction coefficient $K_{ind}$ corrected in step 103 is large, the rate of reduction is decreased, while if the correction quantity is small, the rate of reduction is increased.

Thus, if the value of the cylinder-common correction coefficient is computed on the basis of the value of each cylinder-individual correction coefficient, the value of the cylinder-common correction coefficient will be set so that the fuel injection quantity for all the cylinders can be corrected efficiently and accurately.

Embodiment 2

Figure 4:
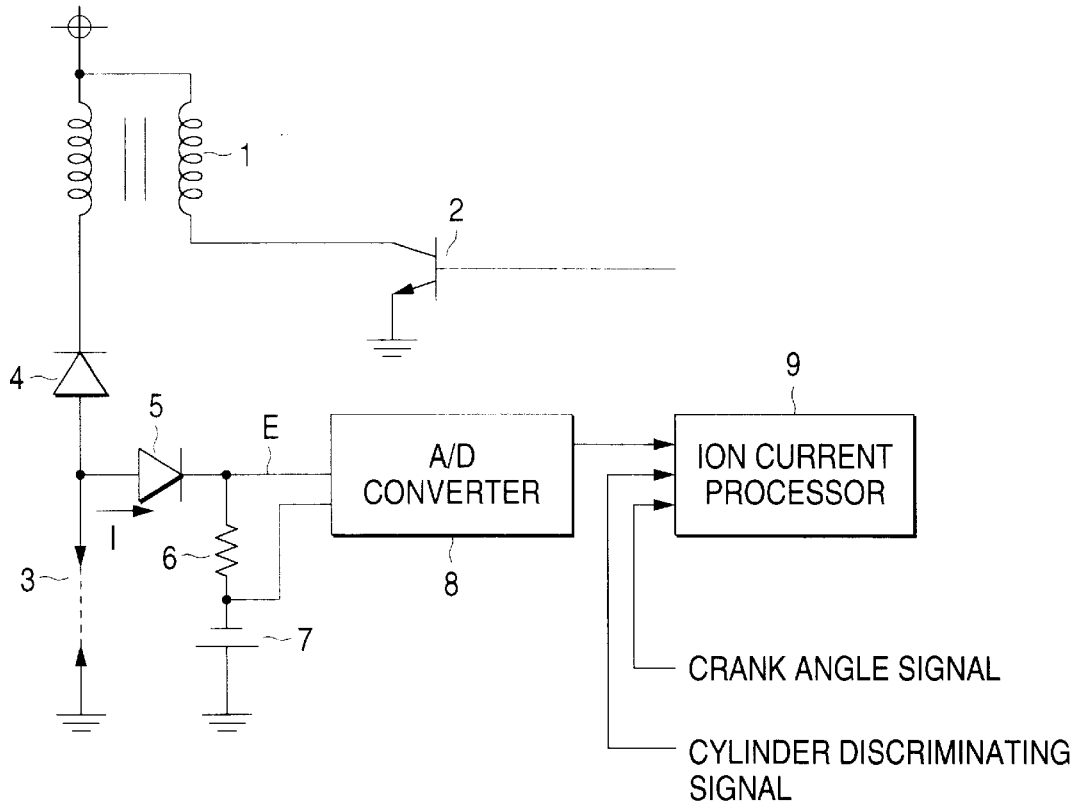
FIG. 4 is a schematic diagram showing a combustion state measuring system according to the second embodiment.

FIG. 4 is a view showing a system for measuring the combustion engine of an engine according to the second embodiment of the present invention. In this figure, like reference numerals refer to like elements in FIG. 1.

Figure 5:
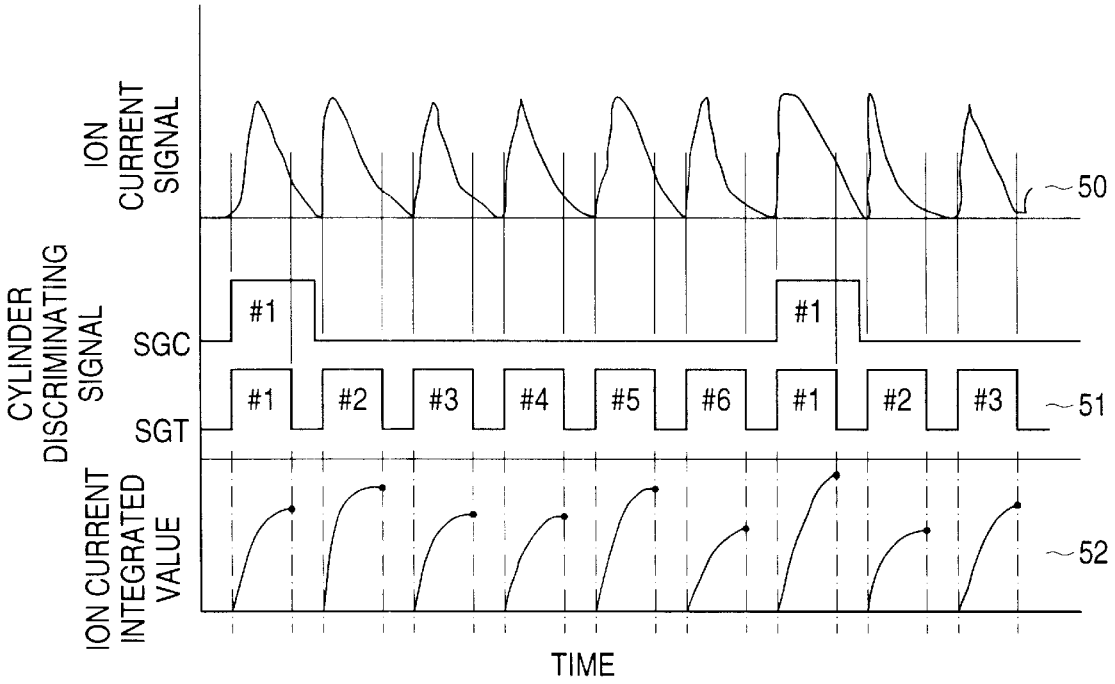
FIG. 5 is a view showing the ion current signal and combustion state quantity according to the second embodiment.

FIG. 5 is a graph showing an ion current signal and combustion state. In this graph, reference numeral 51 represents an ion current signal waveform when the ion current output in the combustion cycle of each cylinder is converted into a voltage value. Reference numeral 51 represents a cylinder discriminating signal composed of an SGC signal for discriminating the position of the first cylinder and an SGC signal indicative of the position of each cylinder. Reference numeral 52 represents a combustion state quantity of each cylinder computed on the basis of this reference signal (cylinder discriminating signal).

An explanation will be given of a method of acquiring the combustion state quantity to decide the combustion state for each cylinder.

As shown in FIG. 4, an ion current I is passed through an ignition plug 3 by an ignition coil 1 to detect the ion current I flowing through the ignition plug 3. The detected ion current I is converted into a voltage value by a load resistor 6. The ion current signal E converted in the voltage value is converted into a digital signal by an A/D converter 8. The digital signal is supplied to an ion current processor 9.

The ion current processor 9 acquires a combustion state quantity represented by an ion current integrated value which can be computed by integrating the ion current signal over an integration interval for each cylinder (interval from a rise of the cylinder discriminating signal SGT to a next rise thereof) as illustrated from FIG. 5 on the basis of the crank angle signal and cylinder discriminating signal.

Figure 6:
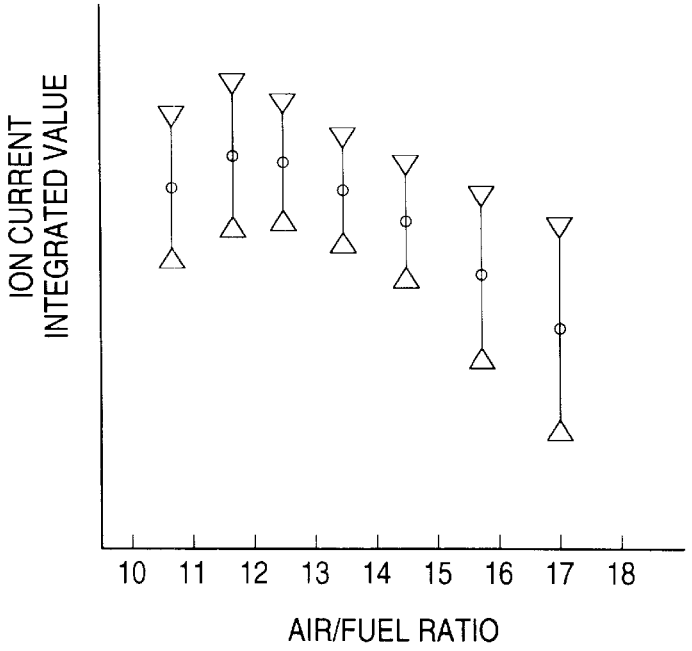
FIG. 6 is a graph showing the relationship between a combustion state quantity and air/fuel ratio.

FIG. 6 is a graph showing a relationship between a combustion state quantity (ion current integrated value) acquired by the processing method according to this embodiment and an air/fuel ratio. In this graph, the abscissa represents the air/fuel ratio while the ordinate represents the ion current integrated value. On the graph, o mark indicates the average value of each air/fuel ratio and marks ΔΔ and ▽Δ indicate the maximum and minimum value, respectively. The standard deviation is represented by the length of the solid line extending from the average value up and down. FIG. 6 actually shows the result acquired by the statistical processing of 20 combustion cycles for the first cylinder (for the other cylinders, substantially the same result can be obtained).

As shown in FIG. 6, when the air/fuel ratio is changed from "rich" to "lean" for the same cylinder, the average value of the integration processing result indicative of the combustion state has a single peak characteristic with a peak in the vicinity of 12 of the air/fuel ratio. It can be seen that the standard deviation varies equally according to the air/fuel ratio. The degree of change from the rich region of the air/fuel ratio of 10–14 to the lean region exceeding this region is substantially represented in terms of the standard deviation or combustion change. Since the average value is changed according to the running areas of the engine, the combustion change can be efficiently represented by an evaluation function.

In accordance with the processing as described above, since the ion current detected in combustion of each cylinder is integrated over a certain combustion interval, the processing result comparable with the other cycles according to the combustion quantity (engine output, cylinder pressure) can be obtained.

Embodiment 3

Figure 7:
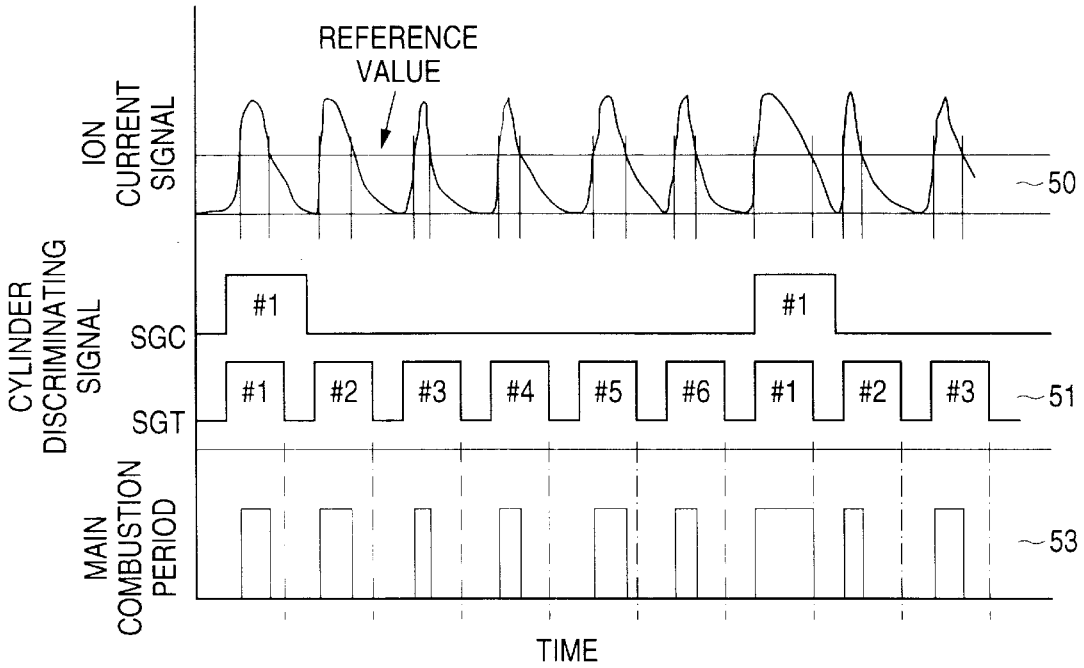
FIG. 7 is a graph showing an ion current signal and a combustion state quantity in the third embodiment of the present invention.

FIG. 7 is a graph showing an ion current signal and combustion state according to the third embodiment. In this graph, reference numeral 50 represents an ion current signal waveform when the ion current output in the combustion cycle of each cylinder is converted into a voltage value. Reference numeral 51 represents a cylinder discriminating signal composed of an SGC signal for discriminating the position of the first cylinder and an SGC signal indicative of the position of each cylinder. Reference numeral 52 represents a combustion state quantity of each cylinder computed on the basis of this reference signal (cylinder discriminating signal).

An explanation will be given of a method of acquiring the combustion state quantity to decide the combustion state for each cylinder.

Like the second embodiment as shown in FIG. 4, the ion current I is converted into a voltage value by a load resistor 6. The ion current signal E is converted into a digital signal by an A/D converter 8. The digital signal is supplied to an ion current processor 9.

By operating the ion current signal on the basis of the crank angle signal and cylinder discriminating signal produced from the crank angle sensor (not shown), the ion current processor 9 acquires a combustion state quantity which is represented by the operation time for each cylinder when the voltage corresponding to the ion current signal exceeding a reference value is produced.

Figure 8:
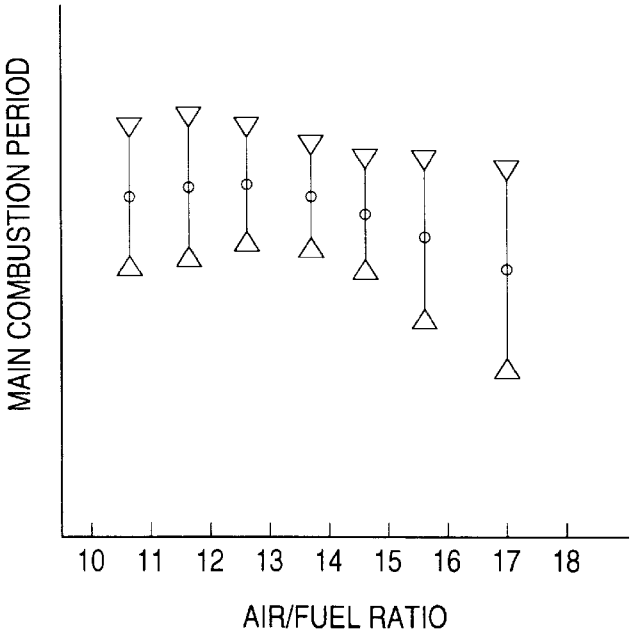
FIG. 8 is a view showing the relationship between the combustion state quantity and an air/fuel ratio in the third embodiment of the present invention.

FIG. 8 is a graph showing the combustion state output result acquired by the processing method according to this embodiment. Like the integration processing result shown in FIG. 6, the standard deviation and average value also vary with the combustion period used as a parameter. Specifically, the combustion change is smallest at the air/fuel ratio of about 13, and it increases as the air/fuel ratio increases.

This processing method can also measure the main combustion period corresponding to an engine output by a simple technique of using a time constant.

An explanation will be given of the arithmetic processing of the combustion change state in the combustion change processor 10 shown in FIG. 1. The remaining processing, which is the same as in the first and second embodiments, will not be explained. Although the processing of the data for a single cylinder will be explained below, it should be noted that the same processing will be performed for the other cylinders.

The combustion change quantity for each cylinder is calculated from the combustion state quantity using the following equation.

$$CVI(N) = \frac{|D(n) - D(n-1)|}{(D(n) + D(n-1))/2 \cdot \Delta t}$$

Here, CV1 (n) indicates the combustion change in the n-th combustion cycle; D(n) indicates a combustion state quantity in the n-th combustion cycle; and D(n−1) indicates the combustion state quantity in the (n−1)th combustion cycle.

Δt indicates the data sampling time corresponding to the combustion cycle.

ICV(n) obtained by integrating this value by a predetermined number of times using the following Equation (3) is used as a combustion change value.

$$ICV(n) = \sum_{n=n-m}^{n} CV1(n)$$

Here, m denotes the number of times of integration. In this embodiment, although it is set for 5, it should not be limited to 5, but can be varied according to the running state of the engine.

Figure 9:
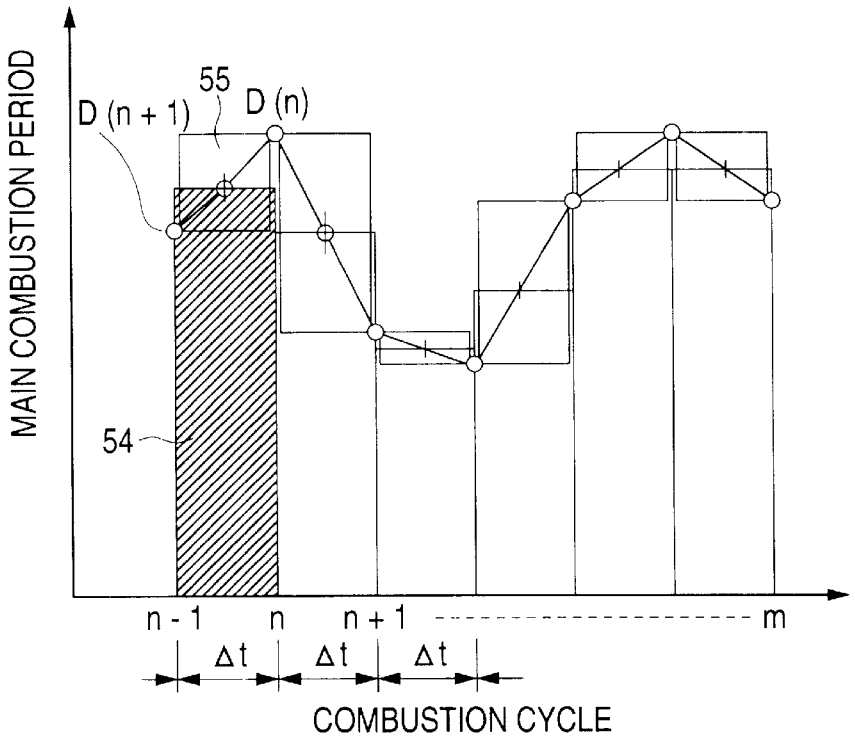
FIG. 9 is a graph showing the relationship between a combustion cycle and a combustion change in the fourth embodiment of the present invention.

FIG. 9 is a graph showing a relationship between the combustion cycle and combustion state quantity according to the forth embodiment. In FIG. 9, the abscissa represents a combustion cycle and the ordinate represents a combustion state quantity. The change is represented by integrating the ratios of the areas of 54 to those of 55 (which are ratios of the absolute values of the differences between the combustion state quantity in the present cycle and that of the previous combustion cycle to the average value of these values) over m cycles. The value of the change is increased to provide a more accurate value.

In this embodiment, the combustion state quantity is represented by the main combustion period, but may be the ion current integrated value.

Embodiment 5

This embodiment relates to the processing of acquiring the combustion change quantity which is different from that in the fourth embodiment of the present invention. Like the fourth embodiment, the remaining processing, which is the same as in the first and second embodiment, will not be explained. Although the processing of the data for a single cylinder will be explained below, it should be noted that the same processing will be performed for the other cylinders.

The combustion change processing method can be expressed by the following equation.

$$CV2(n) = \left| D(n) - \sum_{n=n-m}^{n} D(n)/m \right|$$

Here, CV(2) denotes the combustion change of the n-th combustion cycle; D(n) denotes the number of shifting averages of prescribed data. In the above equation, the combustion change is represented by the difference (absolute value) between the combustion state in the present cycle and the shifting average over the prescribed number of times.

Figure 10:
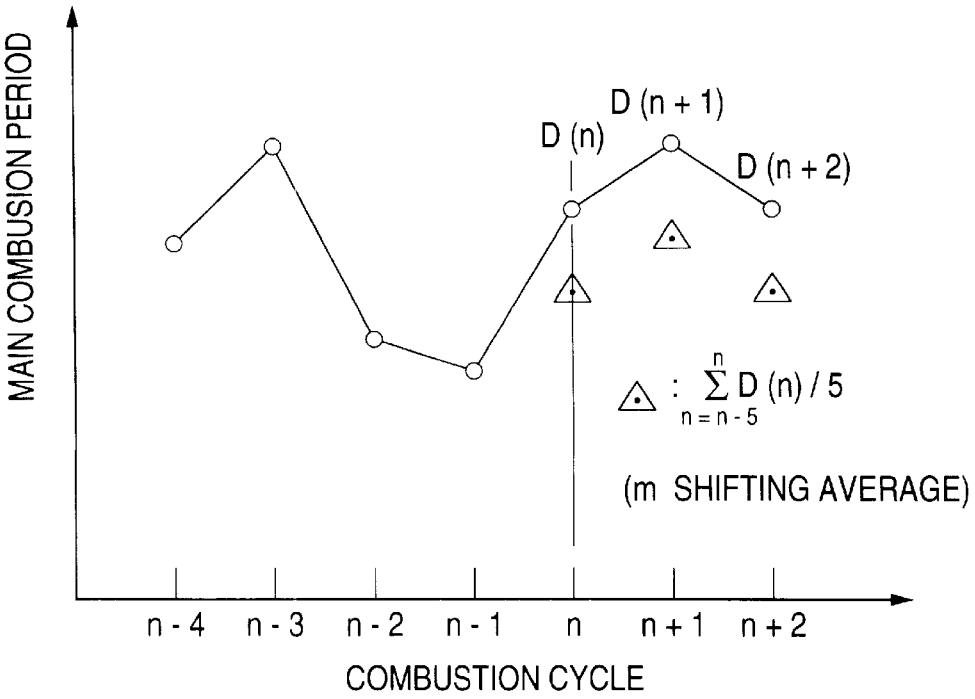
FIG. 10 is a graph showing the relationship between in a combustion cycle and a combustion change in the fifth embodiment of the present invention.

FIG. 10 is a graph showing a relationship between a combustion cycle and a combustion state quantity according to the fifth embodiment. In FIG. 10,combustion cycle and nets a combustion cycle and the ordinate represents a combustion state quantity. The combustion change quantity is represented by integrating the ratio of the value of Δ to the combustion state quantity (i.e. the value of ○) over m cycles so that the value of the change is increased to provide a more accurate value.

In this embodiment, the combustion state quantity is represented by the main combustion period, but may be the ion current integrated value.

Embodiment 6

An explanation will be given of the processing of computing the correction coefficient for each cylinder from the combustion change states of all the cylinders in the fuel injection quantity corrector 11 as shown in FIG. 1 according to the first embodiment. The remaining processing, which is the same as in the first and second embodiment, will not be explained. Although the processing of the data for a single cylinder will explained below, it should be noted that the same processing will be performed for the other cylinders.

The fuel injection quantity corrector 11 acquires a combustion state deviation by the following equation.

$$DV(i, n) = 6 \cdot CV(i, n) \Big/ \sum_{i=1}^{6} CV(i, n)$$

Here, i denotes a cylinder number. This embodiment relates to an application to a six-cylinder engine. Symbol n denotes a combustion cycle.

DV(i, n) denotes a deviation of the change value of the i-th cylinder over n combustion cycles and a multi-cylinder; and CV(i, n) denotes a combustion change of the i-th cylinder over n combustion cycles which is acquired by the combustion change processor 9.

On the basis of the combustion state deviation acquired for each cylinder, the fuel injection quantity of a cylinder with the largest deviation, for example, is corrected.

From the above equation, the degree of the combustion change is acquired in comparison with the other cylinders so that it can be used as a correction value for suppressing the combustion change.

The present invention, which is constructed as described above, can provide the following effects.

In the invention, while the combustion change for each cylinder is suppressed, the fuel injection quantity is reduced in average. Thus, the composition of the non-combustion gas in an exhaust gas can be reduced.

In the invention, while the combustion change for each cylinder is suppressed, the fuel injection quantity is changed in accordance with the correction degree for suppressing the combustion change. Therefore, while the combustion change for each cylinder is suppressed, the fuel injection quantity can be efficiently reduced in average, thereby reducing the composition of the non-combustion gas in an exhaust gas.

In the invention, while the combustion change for each cylinder is suppressed, the rate of changing the fuel injection quantity is changed in accordance with the correction amount for suppressing the combustion change. Therefore, while the combustion change for each cylinder is suppressed, the fuel injection quantity can be efficiently reduced in average, thereby reducing the composition of the non-combustion gas in an exhaust gas.

In the inventions, since the fuel injection quantity is corrected in accordance with the environmental condition, more accurate correction can be realized.

In the invention, since the combustion change in a cylinder the combustion state quantity in a present cycle and that in a cycle prior to the present cycle, even when the combustion state of each cylinder varies in each cycle, the combustion state of each cylinder can be obtained accurately.

In the invention, since a difference in the combustion state among the respective cylinders can be decreased, the vibration of an engine can be suppressed.

In the invention, since the combustion change in a cylinder the combustion state quantity in a present cycle and that in a cycle prior to the present cycle, even when the combustion state of each cylinder varies in each cycle, the combustion state of each cylinder can be obtained accurately.

In the invention, since the fuel injection quantity of each cylinder is corrected so that a difference in the combustion change among the respective cylinders is decreased, a difference in the combustion state among the respective cylinders can be decreased so that the vibration of an engine can be suppressed.

In the invention, since the combustion state for each cylinder is measured, the fuel injection quantity can be corrected for each cylinder.

In the invention, the output proportional to the combustion quantity or to the main combustion period for each cylinder can be obtained.

In the invention, since the period when the ion current is higher than a prescribed value is used as a combustion state quantity, the combustion state quantity can be easily acquired.

In the invention, since the change value is increased, the value of the change is increased to provide a more accurate value.

What is claimed is:

1. A fuel control system for an internal combustion engine comprising:

a cylinder-individual fuel injection quantity correcting means for correcting the fuel injection quantity in each cylinder so that a sum of fuel injection quantities to be supplied to the cylinders of the internal combustion engine having a plurality of cylinders decreases in each combustion cycle of each said cylinder and a difference between a combustion state value of a first cylinder of the internal combustion engine and that of a second cylinder thereof decreases; and a fuel injecting means for injecting into each cylinder the fuel injection quantity for each cylinder of the internal combustion engine as corrected by said cylinder-individual fuel injection quantity correcting means.

2. A fuel control system for an internal combustion engine according to claim 1, wherein the fuel injection quantity supplied to each said cylinder for each combustion cycle of each cylinder is corrected in accordance with an environmental condition of the internal combustion engine.

3. A fuel control system for an internal combustion engine according to claim 1, wherein said cylinder-individual fuel injection quantity correcting means comprises:

a combustion state quantity computing means for computing the combustion state quantity for cylinder from each combustion states of at least two cylinders of the internal combustion engine; and a combustion change quantity computing means for computing the combustion change quantity in each said cylinder on the basis of the combustion state quantity in a present cycle and a cycle prior to the present cycle as computed by said combustion state quantity computing means, wherein the fuel injection quantity for each said cylinder is corrected so that a difference in the combustion change quantity among said cylinders computed by said combustion change quantity computing means decreases.

4. A fuel control system for an internal combustion engine according to claim 3, wherein said cylinder-individual fuel injection quantity correcting means computes a ratio of an average value of combustion change quantities in the respective cylinders to the combustion change quantity in each cylinder as an inter-cylinder difference to correct the fuel injection quantity in each cylinder so that the inter-cylinder difference is decreased.

5. A fuel control system for an internal combustion engine according to claim 3, wherein said combustion state quantity computing means detects an ion current passed through at least two cylinders of the internal combustion engine to compute the combustion state quantity of each said cylinder from the ion current.

* * * * *